US005489916A

United States Patent [19]

Waterman et al.

[11] Patent Number: 5,489,916

[45] Date of Patent: Feb. 6, 1996

[54] HELICAL ANTENNA HAVING ADJUSTABLE BEAM ANGLE

[75] Inventors: Timothy G. Waterman, Eldersburg; Stephen N. Syrylo, Baltimore, both of Md.

[73] Assignee: Westinghouse Electric Corp., Pittsburgh, Pa.

[21] Appl. No.: 296,144

[22] Filed: Aug. 26, 1994

[51] Int. Cl.[6] ..... H01Q 1/36

[52] U.S. Cl. ..... 343/895; 343/872

[58] Field of Search ..... 343/872, 895; H01Q 1/36, 11/08

[56] References Cited

U.S. PATENT DOCUMENTS

| | | | |
|---|---|---|---|
| 3,596,273 | 7/1971 | Francis | 343/895 |
| 4,163,981 | 8/1979 | Wilson | 343/895 |
| 4,375,642 | 3/1983 | Dörrie et al. | 343/895 |
| 5,146,235 | 9/1992 | Frese | 343/895 |

*Primary Examiner*—Donald T. Hajec
*Assistant Examiner*—Tan Ho
*Attorney, Agent, or Firm*—Christopher O. Edwards

[57] ABSTRACT

A quadrifilar helical antenna including four conductive helices having a common central axis, a common direction of turn about said axis, a common pitch, and a common length between opposite ends, the helices being uniformly spaced from each other by 90°, and a single dielectric helix concentric with the common axis, lying within and supporting the conductive helices at a nominal diameter. The dielectric helix has opposite ends, a plurality of turns having said common direction of turn, and a second pitch substantially greater than said common pitch. A casing contains the helices and is rotatably fixed to one end of the dielectric helix. A tuning device is fixed to the other end of the dielectric helix and rotatable relative to said casing, so that rotation of the tuning device twists the dielectric helix to alter the common pitch of the conductive helices without substantial variation from said nominal diameter.

15 Claims, 2 Drawing Sheets

HELICAL ANTENNA HAVING ADJUSTABLE BEAM ANGLE

CROSS REFERENCE TO RELATED APPLICATION

The present application is related to U.S. application Ser. No. 08/297,192, filed Aug. 26, 1944, the disclosure of which is incorporated by reference.

BACKGROUND OF THE INVENTION

1. Field of the Invention

The present invention relates to helical antennas, and, more particularly, to multifilar, circularly polarized helical antennas having an adjustable beam angle.

2. Description of the Related Art

In a typical satellite communication system, outgoing RF signals transmitted from a mobile terminal unit are received directly by the satellite. The satellite in turn retransmits the RF signals to a ground station that is connected by wire to a public switched telephone network (PSTN), which in turn routes the outgoing signals to either a conventional telephone or to another mobile terminal unit of a satellite or cellular network. Incoming signals from a conventional wired telephone are conducted from the PSTN to the satellite ground station, which in turn transmits RF signals to the satellite for retransmission to the mobile terminal unit. Thus, communication can be between two mobile terminal units or between a satellite mobile terminal unit and a conventional telephone connected to a PSTN, or between a unit, for example. In each of the aforesaid conditions, the communication is routed through a PSTN. Also, communication can be with a radio base station type ground station which communicates via terrestial RF with mobile radios, such as taxicabs.

Presently, satellite systems that cover large geographical areas typically use several satellites that follow different paths at low or medium altitudes so that at least one satellite is at all times covering the desired geographical area. From the stand point of receiving signals, the low and medium altitude satellites have the advantage of being able to transmit a signal that reaches a mobile terminal unit at the earth's surface with a relatively large amplitude and without appreciable fading. However, such satellite networks are limited in their coverage area per satellite.

It has been proposed, to provide a satellite communications network that utilizes a high altitude geosynchronous satellite which is capable of covering an area corresponding to a substantial portion of the North American continent, so that a total of approximately 6 satellite beams will cover the entire continent from Alaska to Mexico. The satellite for such a network will be approximately 22,600 miles above the equator and will be designed to operate in the L-Band of RF frequencies. For example, the frequency of the signal being transmitted to the satellite will be between 1626 MHz to 1660 MHz; and the frequency of the signal received from the satellite will be between 1525 MHz to 1559 MHz. Energy travelling this great distance undergoes huge attenuation such that the power flux density incident at the antenna of the mobile unit is approximately $10^{-14}$ watts per square meter.

An acceptable antenna for mobile units, such as automobiles, trucks and the like, must not only be capable of receiving and transmitting signals of the aforementioned character, but in addition, must meet the space and dimensional constraints, resistance to shock, and mechanical vibrations attendant to the operation of such mobile units. In addition, overland travel in relation to the geosynchronous satellite mandates angular beam adjustment ranging from near the horizon to nearly vertical.

Small diameter, circularly polarized, helical mast antennas represent a viable candidate for mobile units in such geosynchronous satellite communication systems from the standpoints of size and other physical requirements of the mobile units. Also it is known that such antennas make a conical beam in space in which the elevation angle is a function of and thus varies with the pitch (turns per unit length) of the conductive helical filars of such antennas. Although the pitch of a helix may be adjusted by twisting opposite ends relative to each other, the required flexibility of the conductive filars in a helical antenna, particularly such an antenna of an overall length to require helices of multiple turns, makes it difficult to maintain spacing between turns of a single helix and, more acutely, the spacing between turns of multiple helical filars. Moreover, in such antennas, very small changes in conductive filar or wire position can change the impedance along the length of the antenna by several wavelengths. Such a change of impedance along the length of the antenna can steer the antenna beam and cause other poor performance such as high backlobes, poor mismatch and the like.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the circularly polarized helical antenna of the invention comprises at least one conductive helix having a central axis, the conductive helix extending about the axis in a direction of turn at a first pitch, and a supporting helix within the conductive helix and concentric with the central axis. The supporting helix extends about the central axis in the same direction of turn as the conductive helix but has a second pitch substantially larger than the first pitch. At least the opposite ends of the conductive helix are connected to the supporting helix so that when the supporting helix is twisted on the axis, the pitch of the conductive helix is changed.

The antenna is preferably embodied in a quadrifilar helical antenna including four conductive helices having a common central axis, a common direction of turn about said axis, a common pitch, and a common length between opposite ends, the helices being uniformly spaced from each other by 90°. The supporting helix is preferably dielectric and supports the conductive helices at a nominal diameter. A casing may contain the helices and be fixed to one end of the dielectric supporting helix. A tuning device fixed to the other end of the dielectric helix and rotatable relative to the casing provides for twisting the dielectric helix to alter the common pitch of the conductive helices without substantial variation from nominal diameter. Another feature of the invention involves provision of multiple pivot connections of the conductive helices along the length of the supporting helix to insure the spacing between the conductive helices remains uniform throughout.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

As used in the ensuing description and in the appended claims, the term "pitch," as applied to a helix or a helical configuration, means the number of turns through which the helix extends for a unit of distance along the axis of the helix. Also, it is contemplated and intended that the word helix not imply a plurality of turns. In particular, a "helix," as used herein and in the appended claims may be of a length between opposite ends shorter than the unit of length used to determine the pitch, and as such, constitute less than one turn. Also, the term "direction of turn" in a given helix may be clockwise or counterclockwise. While the direction of turn in a given helix is one or the other of clockwise or counterclockwise directions, the term is relevant in relating more than one helix in an assembly of multiple helices.

In accordance with the present invention, a circularly polarized helical antenna is provided in which at least one, preferably four, conductive helices extend about a central axis in a given direction of turn. The conductive helix or helices are carried by a supporting helix concentric with the axis of the conductive helices and having the same direction of turn as the conductive helices. The conductive helices are connected at opposite ends thereof to the supporting helix in a manner so that the supporting helix establishes a nominal diameter of the conductive helices. The pitch of the supporting helix, however, is substantially greater than the pitch of the conductive helices so that the supporting helix may be twisted along its length without substantial change in diameter. On the other hand, the conductive helices are changed substantially in pitch while supported on the twisted supporting helix.

In the illustrated embodiment, as shown in FIGS. 1–4 of the appended drawings, a helical antenna 10 includes four conductive helices 12, 14, 16 and 18 extending about a common central axis 20 at a constant common pitch in a counterclockwise direction of turn between opposite ends. The conductive helices lie on the outer surface of a supporting single helix 22 concentric with the central axis 20 and also having a counterclockwise direction of turn. By comparison with the conductive helices 12, 14, 16 and 18, the supporting helix 22 has a larger number of turns per unit lengths or a pitch substantially greater than the pitch of the conductive helices.

Figure 1:
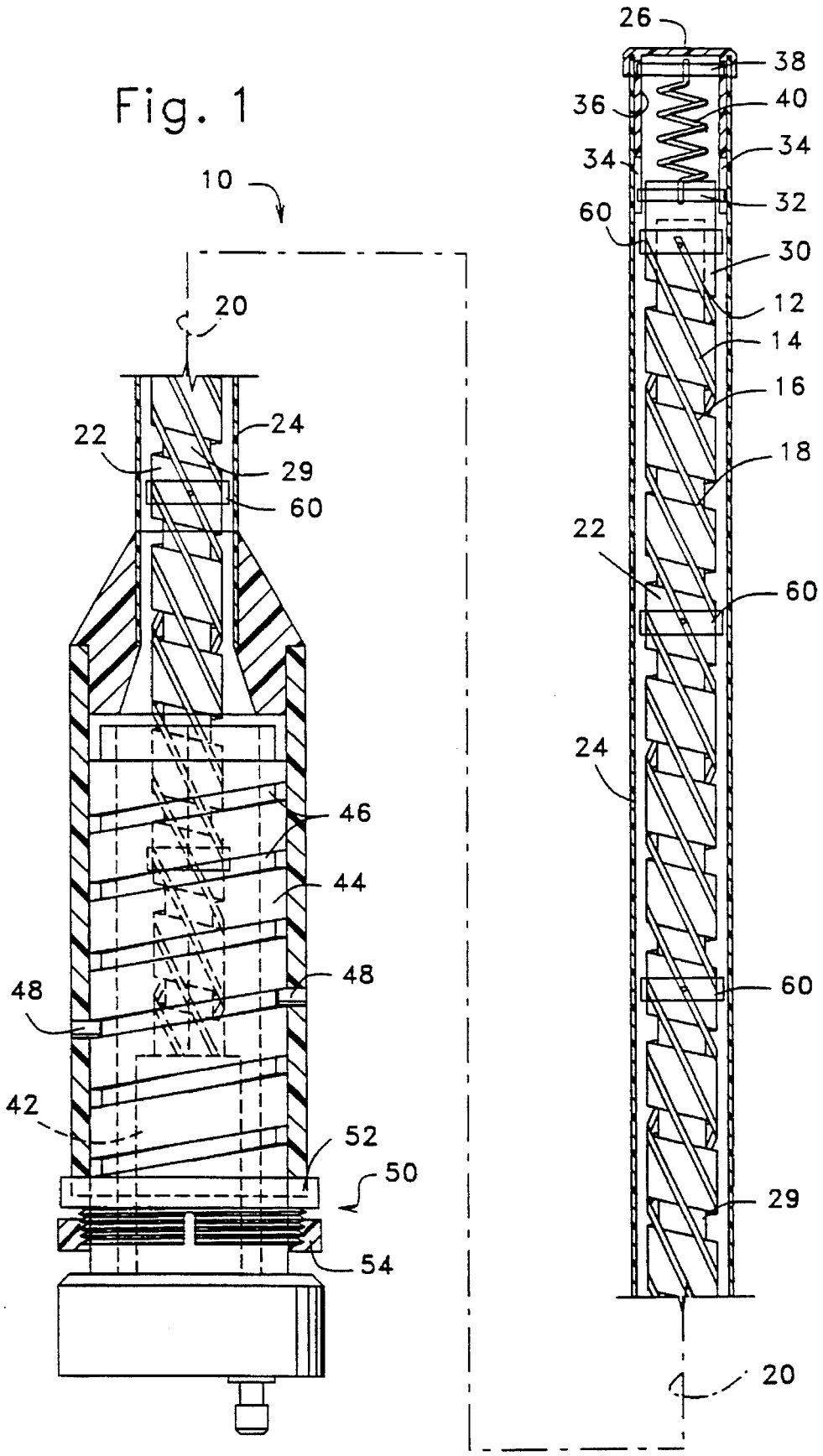
FIG. 1 is a fragmented longitudinal cross-section through a presently preferred antenna embodiment of the invention.
Figure 4:
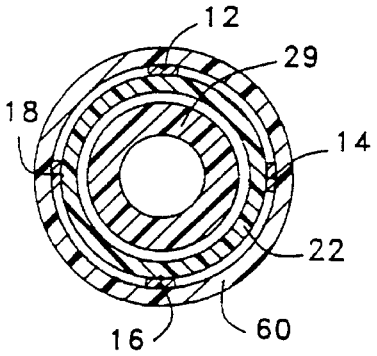
FIG. 4 is an enlarged cross-section on line 4—4 of FIG. 2.

As shown in FIG. 1, the helices 12, 14, 16, 18 and 22 are contained within an elongated cylindrical casing 24 having a cap 26 secured at the top end thereof by suitable means such as an adhesive, ultrasonic welding, or the like. The bottom end of the casing 24 is secured similar fashion to a base 28 of generally cylindrical shape, but larger in diameter than the casing 24.

Although the structure of the conductive helices 12, 14, 16 and 18 will be described in more detail below, the supporting helix 22 is preferably formed of a dielectric material such as Teflon and further preferably formed by a helical cut in a tube of Teflon. In this manner, the individual turns of the supporting helix 22 are relatively large in their dimension parallel to the central axis 20 and may have an adequate radial thickness for physical support of the conductive helices 12, 14, 16 and 18. Additional support along the length of the helices is provided by a rigid tube 29 extending with the supporting helix 22 for substantially the full length thereof, As may be seen in FIG. 1, the top end of the supporting helix 22 is defined as a cylindrical tube portion 30 which supports a diametric pin 32 at its upper portion. Opposite ends of the pin 32 are received in axial slots 34 formed in an inner sleeve extension 36 of the end cap 26. A second pin 38 is secured in the cap against both angular and axial movement. A tension spring 40 extends between the fixed pin 38 and the diametric pin 32 in the end of the supporting helix 22. Also, the top ends of the conductive helices 12, 14, 16 and 18 are secured at 90° spacing about the cylindrical portion 30 of the inner or supporting helix 22. The manner in which this connection is made will be described in more detail below.

The bottom ends of both the conductive helices 12, 14, 16 and 18 and the supporting helix 22 are fixed to an electronics housing 42, in turn, fixed within a cylindrical tuning member 44 that extends within and is rotatable relative to the base 28. The tuning member 44 is provided with an external Acme-type thread 46 of uniform pitch to be engaged by at least one pair of diametric pins 48 anchored in the cylindrical base 28. Thus it will be appreciated that rotation of the tuning member 44 relative to the base 28 will result in axial movement thereof relative to the base 28 and to the casing 24. A compression clamp 50, having a tapered external thread portion 52 secured to the bottom end of the base 28, and an internally threaded bushing 54 is provided to releasably fix the tuning member 44 in a position to which it is adjusted.

In accordance with the present invention, the conductive helices are formed as thin film-like strips or ribbons and secured pivotally at intervals along their lengths to the supporting helix.

Figure 5:
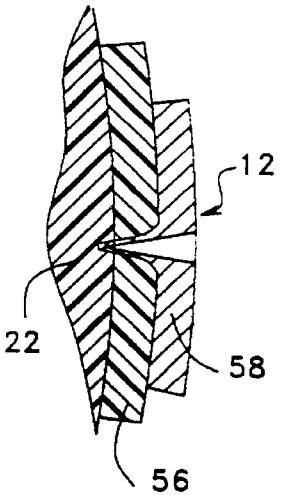
FIG. 5 is a greatly enlarged fragmentary cross-section in the plane of FIG. 4, but illustrating the construction of an individual conductive filar in the illustrated embodiment.

In the illustrated embodiment, as shown most clearly in the enlarged cross-section of FIG. 5, the conductive helix 12 is shown to include a thin dielectric, preferably Mylar, substrate 56 and a metallic conductor, preferably copper, provided as layer 58 on the substrate 56. In particular, a conductor of the cross-section illustrated in FIG. 5 is provided by electro-coating a sheet of Mylar with copper, etching the copper layer to provide strips along the sheet and cutting the Mylar sheet between the etched portions of the copper layer to provide the strip cross-section illustrated. As a result of the cross-section shown, the conductive helices are formed of ribbon-like strips which exhibit a greater degree of flexibility in the direction of the ribbon thickness than in the direction of width.

Pivotal attachment of the conductive helices 12, 14, 16 and 18 along the lengths thereof to the supporting helix 22 is accomplished preferably by piercing in the conductive helix to effect a detent-like connection of the conductive helices 12, 14, 16 and 18 to the supporting helix 22. Although it is possible that the mere piercing of the helices of the conductive helices in this fashion will retain the spaced pivotal connections thereof to the supporting helix, the connection is augmented by the provision of exterior retaining sleeves 60 along the lengths of the assembled, conductive, and supporting helices. The sleeve 60 merely retains the pivotal detenting of the conductive helices to the supporting helix without interfering with pivotal movement of the conductive helices relative to the supporting helix 22.

The physical connection of the conductive helices to the supporting helix as represented by the detented pivots, ensures uniformity of spacing between the respective conductive helices 12, 14, 16 and 18 and maintains this spacing even in the presence of mechanical vibrations which would tend to cause the conductive helices to slip axially along the central axis 20.

Figure 2:
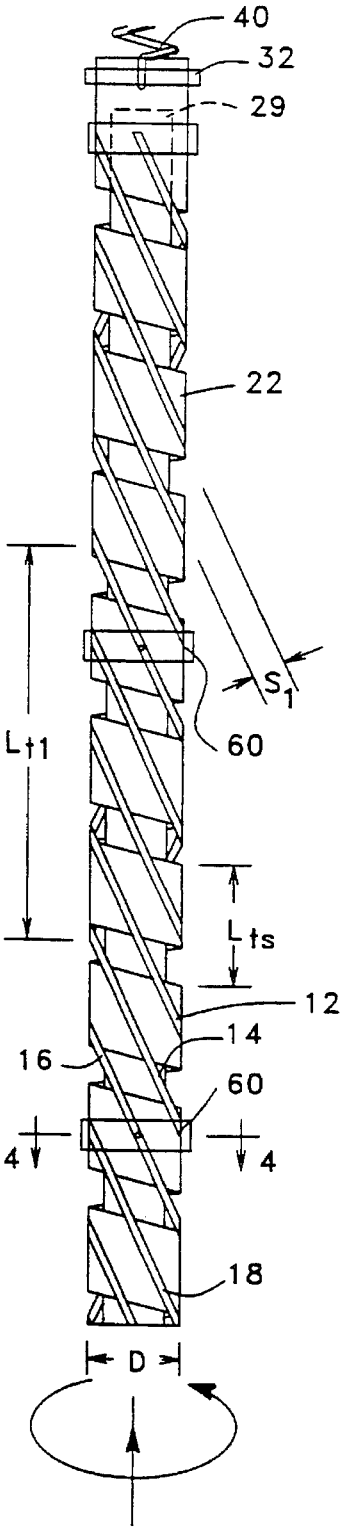
FIG. 2 is a fragmentary elevation showing the helical components of the present invention.

In the operation of the illustrated embodiment, with the threaded member in the position as shown in FIG. 1, the conductive helices 12, 14, 16 and 18 are in condition of maximum pitch. This condition is generally illustrated in FIG. 2 of the drawings. Also in this condition, the beam of the antenna is in a relatively high scan position or elevated at a large angle from the horizon.

To reduce the elevation of the beam, the pitch of the conductive helices 12, 14, 16 and 18 is decreased by rotating the tuning member 44 out of the base 28, decreasing the pitch and increasing the length of the conductive helices. This condition is shown in FIG. 3.

In practice, the dimensions of the antenna 10 may be in the range of between 2 and 4 feet in length, preferably 3 feet in overall length between the bottom of the tuning member 44 and the cap 26. The nominal diameter D (FIGS. 2 and 3) of the conductive helices 12, 14, 16 and 18 is in the range of ⅜ to ¾ inch, preferably ½ inch. The relative lengths of individual turns in the conductive helices are represented in FIGS. 2 and 3 by the dimensions $L_{t1}$ and $L_{t2}$. Also, the length of one turn in the supporting helix is represented by the dimension $L_{ts}$. By a comparison of FIGS. 2 and 3 it will be noted that while the pitch of the conductive helices changes substantially, the diameter of the helices does not change substantially and, moreover, the spacing $S_1$ and $S_2$ between the respective conductive helices does not change drastically. Moreover, because of connection of the conductive helices 12, 14, 16 and 18 to the supporting helix, the spacing $S_1$ and $S_2$ remains uniform throughout the length of the antenna.

Figure 3:
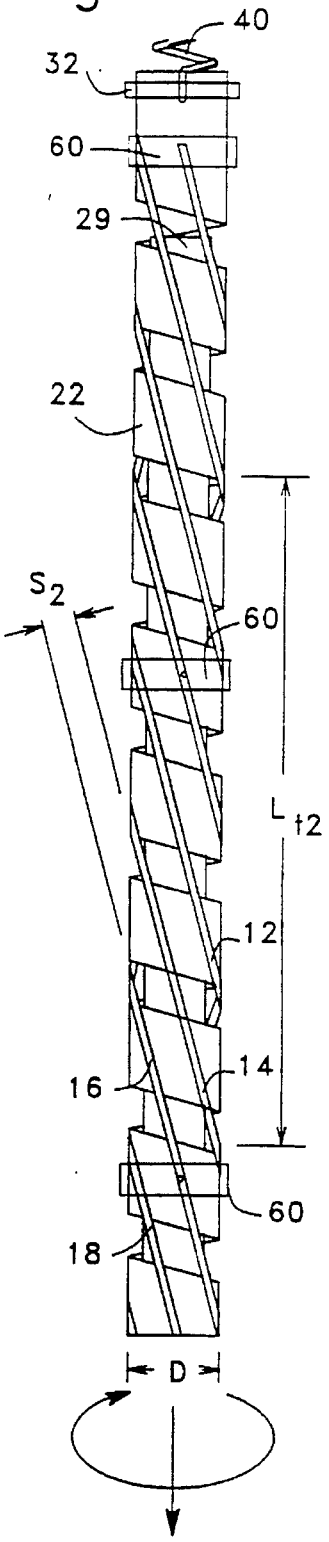
FIG. 3 is an elevation similar to FIG. 2, but showing the helices of the antenna in a different condition.

Also as noted in FIGS. 2 and 3, rotation at the bottom end of the helices in a direction opposite to the direction of helix wrap to increase the pitch of the conductive helices 12, 14, 16 and 18 and shortens the length between opposite ends of the helix assembly. Conversely, rotation in the direction of helix wrap to reduce the pitch decreases the length between opposite ends of the helical assembly and decreases the pitch. Because of this change in length, the tuning member 44 is provided with the thread 46 so that rotation of the tuning member results in axial movement thereof. In this respect, it is noted that the pitch of the thread 46 is constant in the illustrated embodiment. The rate of elongation by twisting the helix assembly, however, is not linear. Thus, the spring 40 compensates for the difference in helix elongation as against axial travel by the tuning member 44. It is contemplated that the thread 46 on the tuning member 44 may be made variable to coincide fully with the rate of helix elongation and shortening. In that case, the spring 40 would not be needed.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A circularly polarized helical antenna comprising:

at least one conductive helix having a central axis and opposite ends, the conductive helix extending about the axis in a direction of turn at a first pitch; and a twistable supporting helix within said conductive helix and concentric with the central axis, the supporting helix extending about the axis in the same direction of turn as the conductive helix and having a second pitch substantially larger than the first pitch, at least the opposite ends of the conductive helix being connected to the supporting helix so that when the supporting helix is twisted on the axis, the pitch of the conductive helix is changed.

2. The antenna recited in claim 1 wherein the supporting helix is formed of dielectric material.

3. The antenna recited in claim 2 wherein the dielectric material is tetrafluoroethylene.

4. The antenna recited in claim 1 wherein said conductive helix is pivotally connected to the supporting helix at spaced intervals between the opposite ends thereof.

5. The antenna recited in claim 1 comprising detent means for pivotally connecting the conductive helix at spaced intervals between the opposite ends thereof, the detent means including a projection of the conductive helix toward the supporting helix.

6. The antenna recited in claim 5 including a sleeve on the exterior of the conductive helix for maintaining engagement of the detent means.

7. A multifilar helical antenna comprising:

a plurality of conductive helices having a common central axis, a common direction of turn about said axis, a common pitch, and a common length between opposite ends, the helices being uniformly spaced from each other;

a single dielectric helix concentric with the common axis, lying within and supporting the conductive helices at a nominal diameter, the dielectric helix having opposite ends, a plurality of turns having said common direction of turn, and a second pitch substantially greater than said common pitch;

means for fixing opposite ends of the conductive helices to said dielectric helix;

a casing containing the helices and connected to one end of the dielectric helix;

a tuning device connected to the other end of the dielectric helix and rotatable relative to said casing;

whereby rotation of the tuning device twists the dielectric helix to change the common pitch of the conductive helices without substantial variation from said nominal diameter.

8. The antenna recited in claim 7 wherein the length of the dielectric helix changes with changes in the common pitch of the conductive helices and including means for causing axial movement of said tuning device in a direction of displacement of the other end of the dielectric helix due to the change in length.

9. The antenna recited in claim 8 wherein the casing is connected to the one end of the dielectric helix through a spring to further accommodate changes in the length of the dielectric helix.

10. The antenna recited in claim 7 including releasable clamping means for securing said tuning device to the casing in an adjusted position of rotation.

11. The antenna recited in claim 7 wherein each of said plurality of conductive helices comprises a ribbon having a substrate layer and a conductive layer.

12. The antenna recited in claim 11 wherein the substrate is wider than the conductive layer.

13. The antenna recited in claim 12 wherein the conductive layer is copper.

14. The antenna recited in claim 7 including means for pivotally connecting each of the plurality of conductive helices to said dielectric helix at spaced intervals between the respective opposite ends.

15. The antenna recited in claim 14 wherein each of said plurality of conductive helices comprises a ribbon having an inner thin dielectric substrate layer and an outer metallic conductive layer, the means for pivotally connecting each of the plurality of conductive helices to said dielectric helix comprising a detent formed by piercing the metallic conductive layer through the dielectric substrate layer and into the dielectric helix.

* * * * *